United States Patent [19]

Iannucci

[11] Patent Number: 4,991,804

[45] Date of Patent: Feb. 12, 1991

[54] DISPLAY STAND

[76] Inventor: Steve Iannucci, 79 Holiday Dr., W. Caldwell, N.J. 07006

[21] Appl. No.: 441,760

[22] Filed: Nov. 27, 1989

[51] Int. Cl.[5] ..... A47F 5/11

[52] U.S. Cl. ..... 248/174; 206/44 R; 206/45.24; 211/132

[58] Field of Search ..... 248/174, 300, 152; 211/72, 73, 128, 149, 132; 206/44 R, 45, 45.2, 45.24

[56] References Cited

U.S. PATENT DOCUMENTS

| | | | |
|---|---|---|---|
| 1,614,265 | 1/1927 | Stockton | 211/73 X |
| 2,324,232 | 7/1943 | Pantalone | 248/174 X |
| 2,940,710 | 6/1960 | Adams | 248/174 |
| 3,141,555 | 7/1964 | Funke et al. | 206/44 R |
| 3,438,508 | 4/1969 | Kuns et al. | 206/44 R |
| 4,197,939 | 4/1980 | Dogliotti | 248/174 X |
| 4,582,283 | 4/1986 | Schmitt | 248/174 |
| 4,726,476 | 2/1988 | Smith | 248/174 X |
| 4,813,536 | 3/1989 | Willis | 248/174 X |

*Primary Examiner*—Karen J. Chotkowski

*Attorney, Agent, or Firm*—John N. Bain; Raymond J. Lillie

[57] ABSTRACT

A display article including a display portion and a support portion. The display portion includes folding panels which are movable from a first position to a second, or display, position upon contact of the folding panels with the support portion, with the support portion retaining and supporting the folding panels in the second, or display, position.

12 Claims, 4 Drawing Sheets

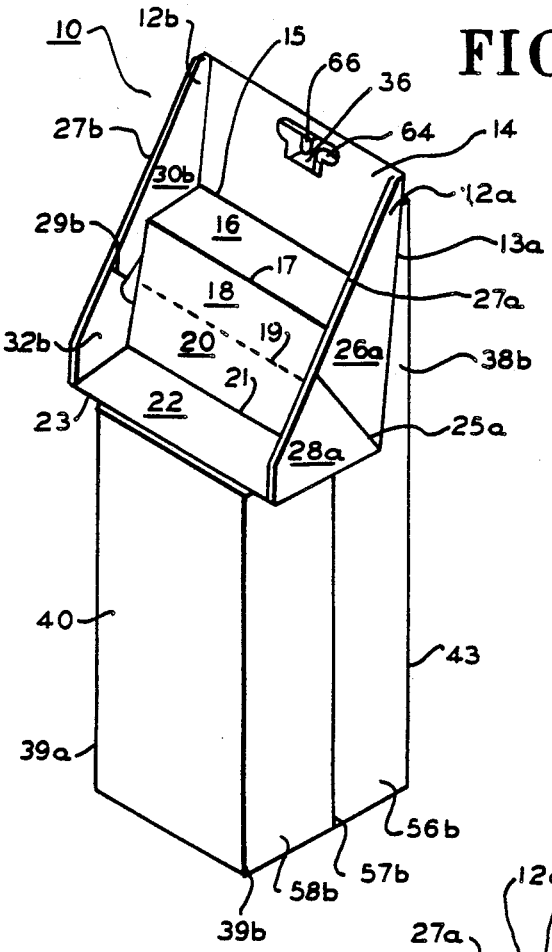
FIG. 6
FIG. 7
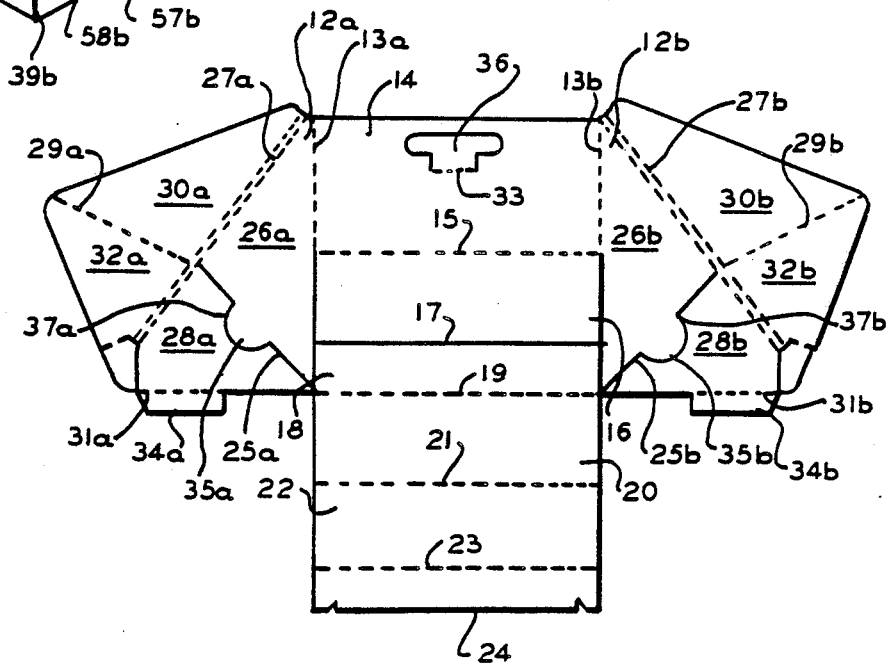

DISPLAY STAND

This invention relates to display articles such as display stands. More particularly, this invention relates to display stands which are easily foldable and easily stored when not in use.

In accordance with an aspect of the present invention, there is provided a display article which comprises a support portion and a display portion connected to the support portion. The display portion comprises first and second side panels, a third side panel connecting the first and second side panels, and a fourth side panel disposed at an angle to the first side panel and the second side panel. The third side panel and the fourth side panel lie in perpendicular planes. The display portion also comprises first, second, and third contiguous folding panels connected between the third side panel and the fourth side panel. The first folding panel is foldable along a first score line adjacent the third side panel and a second score line adjacent the second folding panel. The second folding panel is foldable along the second score line and a third score line adjacent the third folding panel. The third folding panel is foldable along the third score line and a fourth score line adjacent the fourth side panel.

The first, second, and third contiguous folding panels are movable between a first position and a second position. In the first position the first and second folding panels are coplanar with the third side panel and the third folding panel is coplanar with the fourth side panel. The third folding panel is disposed at a right angle to the second folding panel. In the second position, the first folding panel is disposed at a right angle to the third side panel, and is parallel to the fourth side panel. The second and third folding panels are coplanar and disposed at a right angle to the fourth side panel, and are parallel to the third side panel. The first, second, and third folding panels are movable from the first position to the second position upon contact of the first, second, and third folding panels with the support portion.

In a preferred embodiment, the support portion includes at least one ledge portion. The at least one ledge portion is capable of contacting the first, second, and third folding panels, and moving the first, second, and third folding panels from the first position to the second position. The at least one ledge portion supports the first, second, and third folding panels in the second position. In a particularly preferred embodiment, the support portion includes a first side portion and a second side portion. Each of the first and second side portions of the support portion includes at least one ledge portion. Most preferably, the support portion further includes at least a third side portion connected to the first and second side portions of the support portion.

The support portion may further include a fourth side portion, which is connected to the first side portion and the second side portion of the support portion, and is parallel to the third side portion of the support portion.

In a most preferred embodiment, each of the first and second side portions of the support portion includes a score line. Each of the score lines enables the first and second side portions to be foldable inwardly toward each other. At least one of the third side portion and the fourth side portion of the support portion includes a flap portion. The flap portion is foldable inwardly toward the other of the third side portion or the fourth side portion of the support portion. The flap portion, upon folding of the flap portion toward the other of the third side portion or the fourth side portion, extends the first side portion and the second side portion outwardly along the score line of the first side portion and the second side portion, thereby retaining the first side portion of the support portion and the second side portion of the support portion parallel to each other.

In another embodiment, the first side panel and the second side panel of the displaY portion each includes at least one fold line. The at least one fold line of the first side panel enables the first side panel and the second side panel to be foldable toward each other when the first, second, and third folding panels are in the first position hereinabove described.

In accordance with a further embodiment, the display article may further comprise a hinge portion connecting the display portion to the support portion.

In accordance with another aspect of the present invention, there is provided a blank which comprises a first side panel, a second side panel, and a rectangular third side panel. The first side panel and the second side panel are attached to opposite sides of the third side panel and are foldable along first and second fold lines, respectively, along the third side panel. A first folding panel is attached to the third panel and is foldable along a first score line between the first folding panel and the third side panel. A second folding panel is attached to the first folding panel and is foldable along a second score line between the first folding panel and the second folding panel. A third folding panel is attached to the second folding panel and is foldable along a third score line between the second folding panel and the third folding panel. A fourth folding panel is attached to the third folding panel and is foldable along a fourth score line between the third folding panel and the fourth folding panel.

In one embodiment, the first side panel and the second side panel each include a first right triangular portion. In a preferred embodiment, each of the first right triangular portions of the first and second side panels includes a fold line. The fold line of each of the first and second right triangular portions of the first and second side panels extends from the right angle of each of the right triangular portions of the first and second side panels to the hypotenuse of the right triangular portions of the first and second side portions.

This fold line may be in the form of a straight line segment, or may include a curved portion which defines a tab portion. The tab portion aids in preventing buckling of the first and second side panels when the blank is fully assembled as part of a display article.

In another embodiment, each of the first side panel and the second side panel further include a second right triangular portion. The second right triangular portion is attached to the first right triangular portion. The first right triangular portion and the second right triangular portion are foldable along the common hypotenuse.

In accordance with another embodiment, the blank may further comprise a first tab portion attached to the fourth folding portion and foldable along a fold line between the fourth folding portion and the first tab portion. Preferably, the blank may further comprise a second tab portion attached to the first side portion, and a third tab portion attached to the second side portion. Fold lines enable the second and third tab portions to be foldable.

In accordance with yet another aspect of the present invention there is provided a blank which comprises a first side portion, a second side portion attached to the first side portion, and a first fold line between the first side portion and the second side portion. A third side portion is attached to the second side portion, and a second fold line is between the second side portion and the third side portion. A fourth side portion is attached to the third side portion, and a third fold line is between the third side portion and the fourth side portion.

The second side portion and the fourth side portion are of substantially rectangular configuration. The first side portion includes first and second substantially parallel edges and a third edge connecting and disposed at right angles to the first and second edges. The first edge is defined by the first fold line. The first side portion also includes a fourth jagged edge. The third side portion includes first and second substantially parallel edges. The first edge is defined by the second fold line, and the second edge is defined by the third fold line. A third edge connects and is disposed at right angles to the first and second edges. A fourth jagged edge is also present. In a preferred embodiment, each of the first and third side portions includes a score line extending from the third edge to the fourth jagged edge. The score lines of each of the first and third side portions divide each of the first and third side portions into two folding portions.

In accordance with another embodiment, the fourth side portion further includes a foldable flap portion.

In another embodiment, the blank further comprises a hinged tab portion attached to the second side portion.

In yet another embodiment, the blank further comprises at least one tab portion foldably attached to the second edge of the first side portion.

The display article of the present invention, which includes the display portion and the support portion, as well as the blanks used in forming the display and support portions, is made of a material which can be easily folded. Examples of such materials include poster board, corrugated cardboard and other paper materials, as well as foldable plastics, such as foldable polyethylene.

The invention will now be described with respect to the drawings, wherein:

FIG. 6 is a front view of the display article as fully assembled;

FIG. 7 is a top view of a blank of an embodiment of the displaY portion; and

Figure 1:
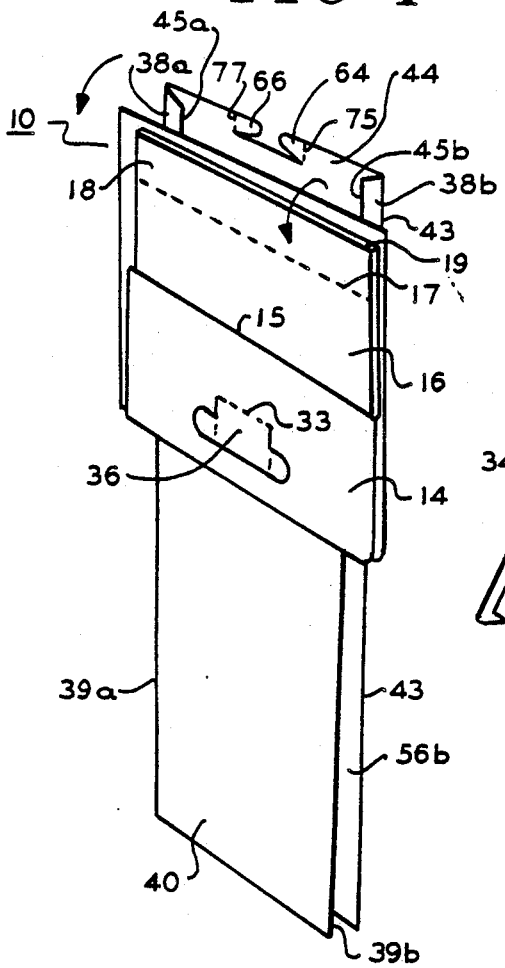
FIG. 1 is a front isometric view of an embodiment a display article in accordance with the present invention wherein the display article is in a folded and flat position.
Figure 2:
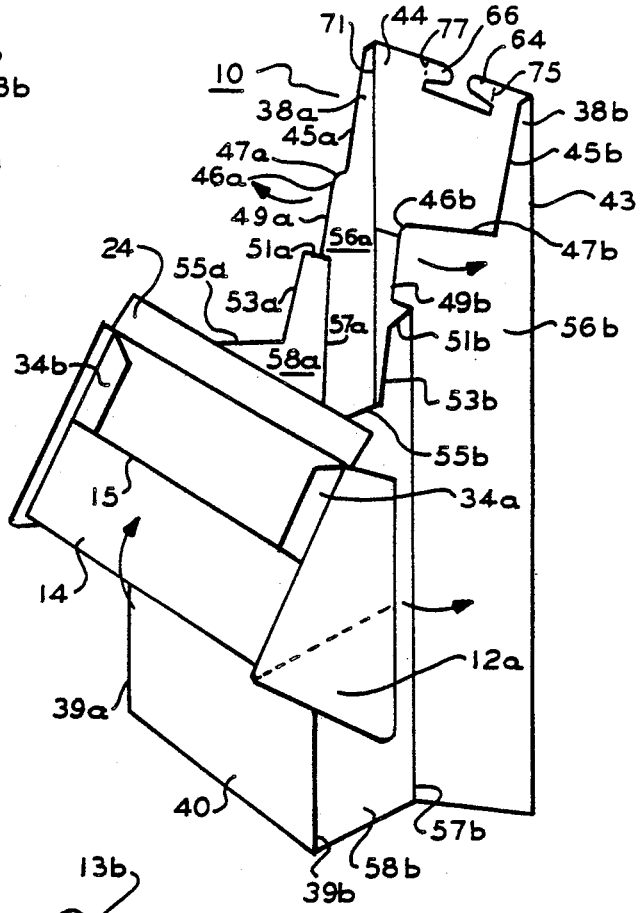
FIG. 2 is an isometric view of the display article wherein the support portion is partially extended outwardly and the display portion is hanging down from the support portion.
Figure 3:
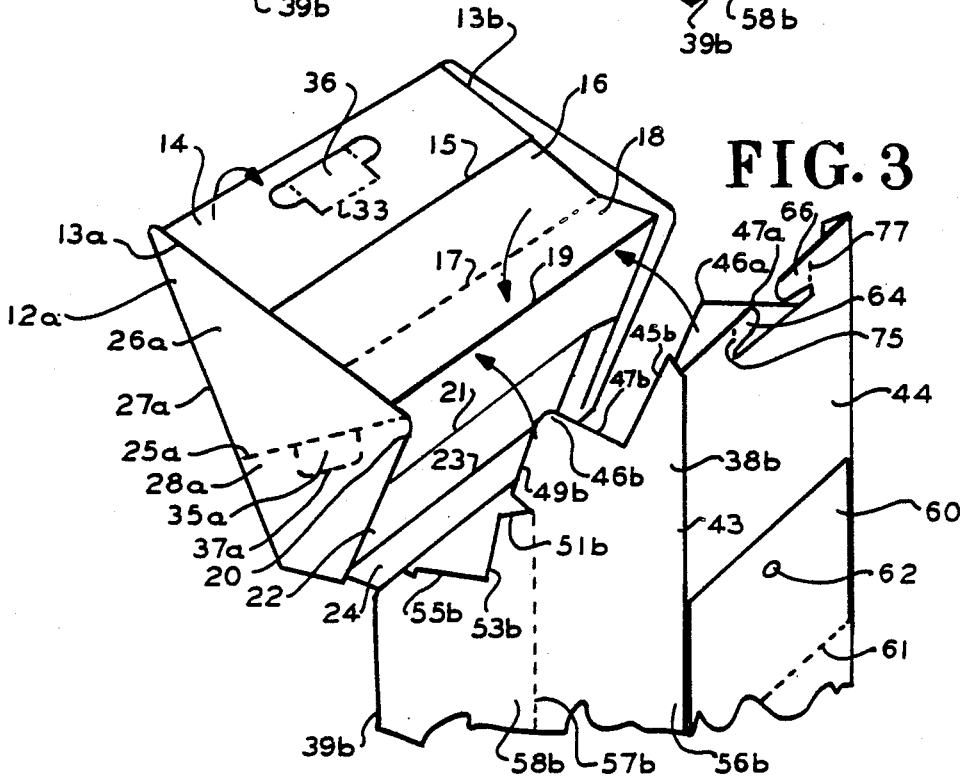
FIG. 3 is a rear isometric view of the display portion being moved toward the support portion.
Figure 3A:
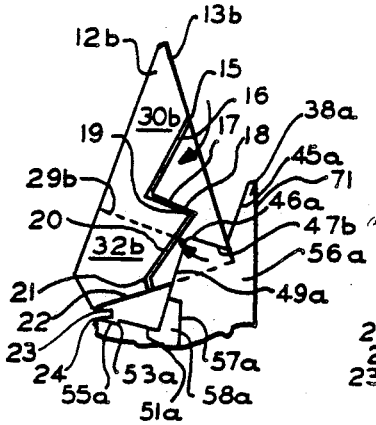
FIG. 3A is a cross-sectional view of a ledge portion of the support portion making initial contact with the first, second, and third folding portions of the display portion.
Figure 3B:
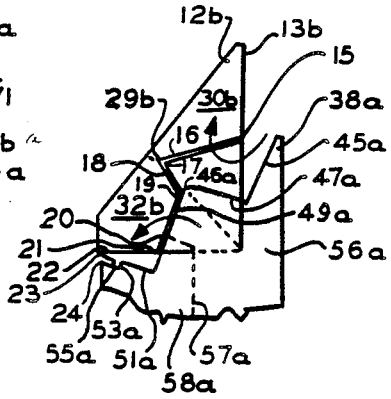
FIG. 3B is a cross-sectional view of the ledge portion of the support portion having moved the first, second, and third folding portions of the display portion to a point midway between the first position and the second position
Figure 3C:
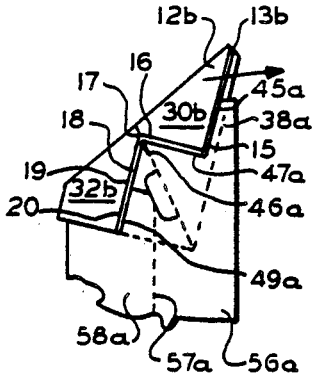
FIG. 3C is a cross-sectional view of the first, second, and third folding portions of the display portion in the second position.
Figure 4:
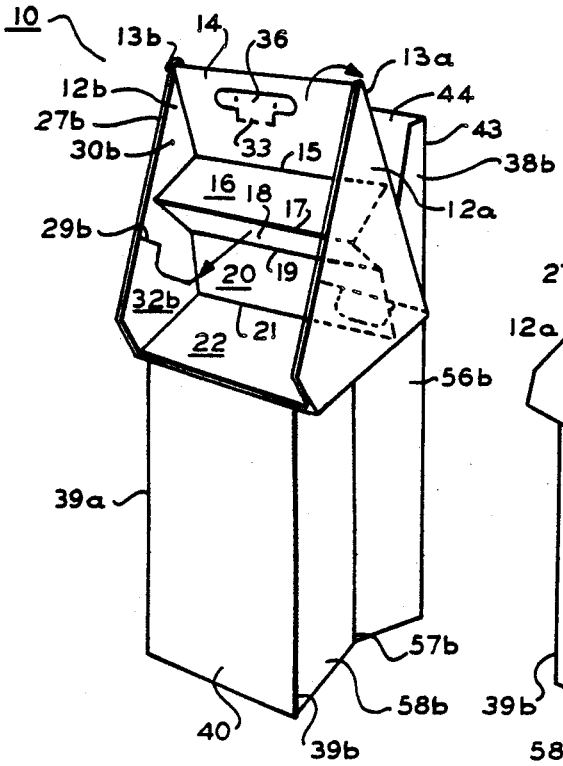
FIG. 4 is a front view of the display stand showing the display portion in the position shown in FIG. 3B.
Figure 5:
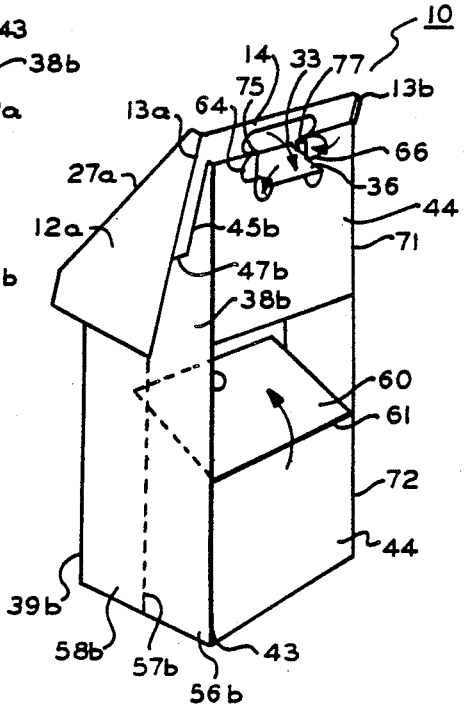
FIG. 5 is a rear isometric view of the display article showing a flap which holds the side portions of the support portion in a fully extended position.
Figure 8:
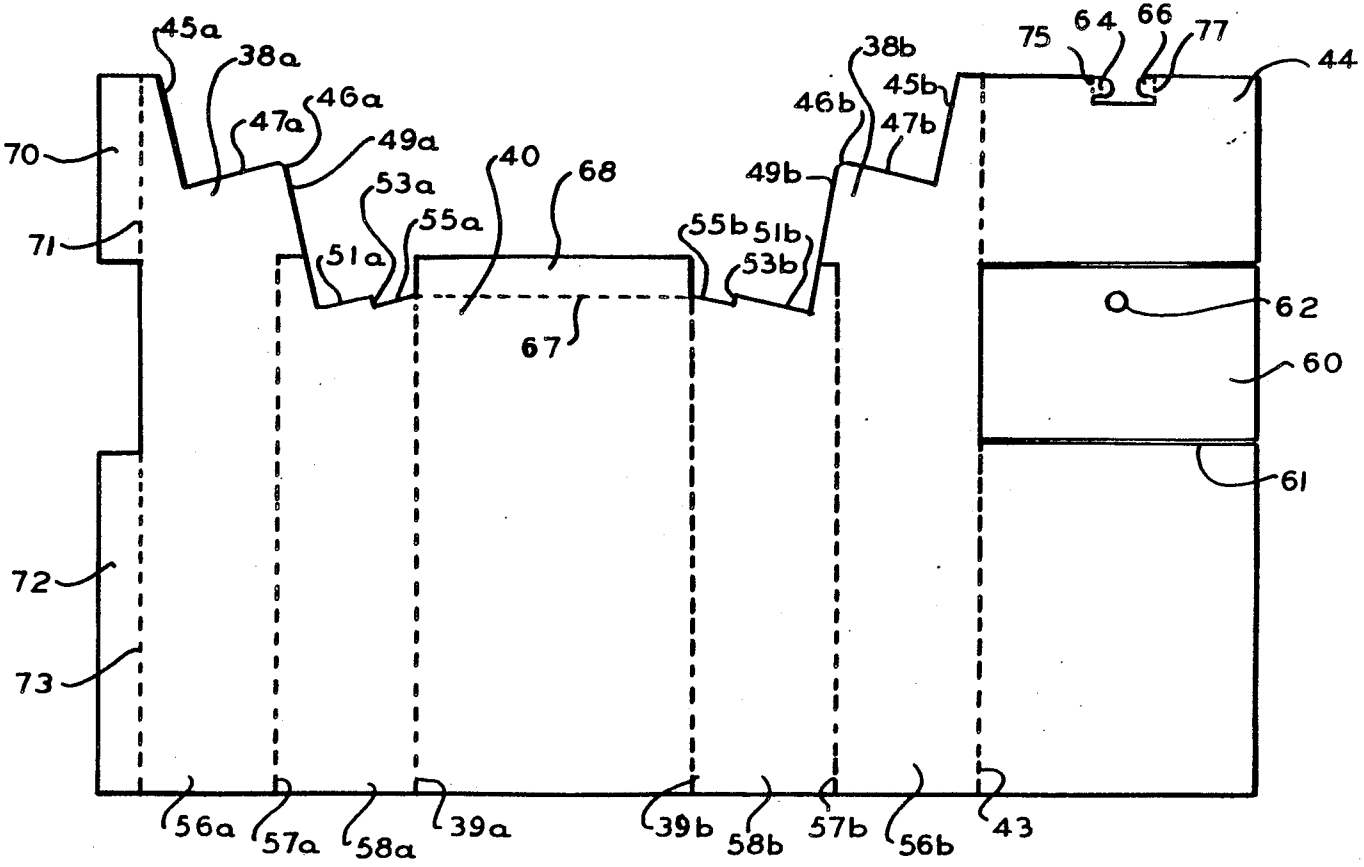
FIG. 8 is a top view of a blank of an embodiment of the support portion.

Referring now to the drawings, the display article 10 includes a display portion and a support portion. The display portion includes first and second side panels 12*a* and 12*b* which are attached to a third side panel 14 along fold lines 13*a* and 13*b*, respectively. Side panel 12*a* is of a right triangular configuration, and is divided into folding portions 26*a* and 28*a* which fold along fold line 25*a*, which runs from the right angle to hypotenuse 27*a*. Optionally fold line 25*a* may include a curved portion 37*a*, which defines a cut-out tab 35*a*, which prevents side 12*a* from buckling when the display stand 10 is fully assembled. Hypotenuse 27*a* is also a fold line, on the opposite side of which is another right triangle comprised of folding portions 30*a* and 32*a* which fold along fold line 29*a*. Folding portions 30*a* and 32*a* are folded along hypotenuse 27*a* over folding portions 26*a* and 28*a* of side portion 12*a*. Fold line 29*a* aligns with fold line 25*a*. Folding portions 26*a*, 28*a*, 30*a*, and 32*a* can be folded inwardly along fold lines 25*a* and 29*a*, when one wishes to flatten the display portion prior to storage or shipping of display article 10. A tab 34*a* is attached to folding portion 28*a* along fold line 31*a*. Tab 34*a* is attached to fourth side portion 22 by conventional means (e.g., glue, staples, etc.) when display article 10 is assembled.

Side panel 12*b* includes folding panels 26*b* and 28*b*, which are foldable along fold line 25*b*. Optionally, fold line 25*b* may include a curved portion 37*b*, which defines a cut-out tab 35*b*, said curved portion 37*b* and cut-out tab 35*b* being analogous to curved portion 37*a* and cut-out tab 35*a* hereinabove described. Hypotenuse 27*b* serves as a fold line between foldable portion 26*b* and foldable portion 30*b*, and between foldable portion 28*b* and foldable portion 32*b*. Fold line 29*b* aligns with fold line 25*b*, thus enabling folding panels 26*b*, 28*b*, 30*b*, and 32*b* to be folded inwardly. Tab 34*b* is attached to folding panel 28*b* along fold line 31*b*, and is attached to fourth side portion 22 when the display portion is assembled.

Within side panel 14 is tab 36 which is foldable along fold line 33, and may be held in place when folded by tabs 64 and 66 of the support portion, thus locking the display portion to the support portion.

Attached to the third side portion 14 by means of first score line 15 is first folding panel 16, which is attached to second folding panel 18 by means of second score line 17. Attached to second folding panel 18 by means of third score line 19 is third folding panel 20. Third folding panel 20 is attached to fourth side panel 22 by means of fourth score line 21. Fourth side panel 22 is attached to hinge tab 24 by means of fold line 23. Hinge tab 24 is attached by conventional means (e.g., glue, staples, etc.) to hinge tab 68, which is hinged along fold line 67, which is adjacent to side panel 40 of the support portion. Thus, the display portion is hingedly connected to the support portion.

Folding panels 16, 18, and 20 are foldable between a first position and a second position upon contact with the support portion. In the first position, folding panels 16 and 18 are coplanar with third side portion 14. Second folding panel 18 is at a right angle to third folding panel 20 along score line 19. Third folding panel 20 is coplanar with fourth side portion 22.

In the second position, first folding panel 16 is at a right angle to third side panel 14 along score line 15, and is at a right angle to second folding panel 18 along score line 17. First folding panel 16 is parallel to fourth side pane]22. Second folding panel 18 and third folding panel 20 are coplanar and are parallel to third side panel 14. Third folding panel 20 is at a right angle to fourth side panel 22 along fourth score line 21.

Score lines 15, 17, 19, and 21 are cut through a major portion of the material of the display portion, and are critical in enabling the first, second, and third folding panels 16, 18, and 20, respectively, to be moved from the first portion to the second position.

The support portion of display article 10 includes a side portion 38*a*, attached to side portion 40 by means of fold line 39*a*, which is attached to side portion 38*b* by means of fold line 39*b*. Side portion 38*b* is attached to side portion 44 by means of fold line 43. Attached to side portion 38*a* is tab 70, which is attached to side portion 38*a*, by means of fold line 71, and tab 72, which is attached to side portion 38*a* by means of fold line 73. The support portion is folded into a boxlike configuration when assembled, and tabs 70 and 72 are attached to side portion 44 by conventional means (e.g., glue or stapling, etc.).

Side 38*a* is parallel to side 38*b*, and front side 40 is parallel to rear side 44. Side 38*a* is divided by score line 57*a* into folding portions 56*a* and 58*a*, and side 38*b* is divided by score line 57*b* into folding portions 56*b* and 58*b*. Side portion 38*a* includes a jagged edge which includes a first ledge formed by edges 45*a* and 47*a*, corner 46*a*, and edge 49*a*, and a second ledge formed by edges 51*a*, 53*a*, and 55*a*. Corner 46*a* makes the initial contact with the first, second, and third folding panels 16, 18, and 20, respectively, of the display portion, to move the first, second, and third folding panels 16, 18, and 20 from the first position to the second position. Edges 45*a* and 47*a*, corner 46*a*, and edge 49*a* of the first ledge then serve to support first, second, and third folding panels 16, 18, and 20 in the second position. Edges 51*a*, 53*a* and 55*a* of the serve to support the fourth side panel 22.

Side 38*b* includes score line 57*b* which divides side 38*b* into folding portions 56*b* and 58*b*. Side 38*b* also includes a jagged edge which includes a first ledge which includes edges 45*b* and 47*b*, corner 46*b*, and edge 46*b*. Corner 46*b*, as well as corner 46*a*, also initially contacts the first, second, and third folding panels 16, 18, and 20 of the display portion, to move first, second, and third folding panels 16, 18, and 20 from the first position to the second position. Edges 45*b*, 47*b*, corner 46*b*, and edge 49*b* of the first ledge aid in supporting the first, second, and third folding panels 16, 18, 20 of the display portion in the second position. Edges 51*b*, 53*b*, and 55*b* of the second ledge serve to support the fourth side panel 22.

Side 40, which serves as the front of the display portion, includes a hinge tab 68, which is attached to side 40 by means of fold line 67. Hinge tab 68 is attached to hinge tab 24 as hereinabove described, thus enabling the display portion to be hingedly attached to the support portion.

Side 44 serves as the rear of the display portion and is parallel to side 40. Side 44 includes tabs 64 and 66, which retain tab 36 of the display portion as hereinabove described. Side 44 also includes flap 60, which is foldable along fold line 61, and also includes thumb hole 62. When the display portion is assembled, one may fold flap 60, along fold line 61 toward front side 40, whereby foldable portions 56*a* and 58*a*, and 56*b* and 58*b*, become fully extended and coplanar.

The folds of the display article 10 enable the display article 10 to be flattened for easy storage and transport. When display article 10 is desired to be used, one extends side panels 38*a* and 38*b* forward by extending folding portions 58*a* and 56*a* and folding portions 58*b* and 56*b* forward from fold lines 71 and 72, and 43, respectively, by pulling front side 40 forward. Folding portions 58*a* and 56*a*, and folding portions 58*b* and 56*b* also extend outwardly by bending along score lines 57*a* and 57*b*.

Side panels 12*a* and 12*b*, which include folding portions 26*a* and 28*a* and 26*b* and 28*b*, respectively, and folding portions 30*a* and 32*a*, and folding portions 30*b* and 32*b* extend outwardly along fold lines 25*a* and 29*a*, and fold lines 25*b* and 29*b*, thus forming hypotenuses 27*a* and 27*b* of right triangular side portions 12*a* and 12*b*, respectively. In addition, the display portion moves downwardly around fold line 23 between fourth side panel 22 and hinge tab 24, and around fold line 67 between hinge tab 68 and front side 40 of the support portion.

At this point, the first, second, and third folding panels 16, 18, and 20, respectively, are in the first position. As one moves the display portion upwardly around fold lines 23 and 67 of adjacent hinge tabs 24 and 68, respectively, corners 46*a* and 46*b* of the first ledges of sides 38*a* and 38*b* of the support portion will contact the third folding panel 20, which will fold along score lines 19 and 21. The folding of third folding panel 20 will cause second panel 18 to fold along score lines 17 and 19, and cause first folding panel 16 to fold along score lines 15 and 17. This folding is aided substantially by further contact of corners 46*a* and 46*b* with the second folding panel 18 and the first folding panel 16 until first, second, and third folding panels 16, 18, and 20 have assumed the second position. Once the first, second, and the third folding panels 16, 18, and 20 are in this position, edges 45*a* and 45*b* abut against third side panel 14, edges 47*a* and 47*b* support first folding panel 16, and corners 46*a* and 46*b* retain first folding panel 16 and second folding panel 18 at a right angle along score line 17. Edges 49*a* and 49*b* abut against second and third folding panels 18 and 20, and retains third folding panel 20 at a right angle to fourth side panel 22 along score line 21. The first, second, and third folding panels 16, 18, and 20 are thus supported in the second position. Fourth side panel 22 is supported by edges edges 55*a* and 55*b* 51*a* and 51*b*, edges 53*a* and 53*b*, and edges 55*a* and 55*b* of the second ledges of sides 38*a* and 38*b*.

To secure the display portion to the support portion, one folds tabs 64 and 66 outwardly along fold lines 75 and 77, respectively, and folds tab 36 downwardly along fold line 33. One then folds tabs 64 and 66 inwardly along fold lines 75 and 77, respectively, in order to retain tab 36 in a folded position.

In order to extend folding portions 56*a* and 58*a* of side 38*a*, and folding portions 56*b* and 58*b* of side 38*b*, one may, if desired fold flap 60 of rear side 44 along fold line 61 toward front side 40. Alternatively, one may allow flap 60 to be coplanar with side 44 and allow the folding portions 56*a* and 58*a*, and folding portions 56*b* and 58*b* to be folded slightly inwardly.

Advantages of the present invention include the ability to provide a display article or stand which is easily foldable so that the display article may be folded into a flat configuration for easy storage and transport. The display article can also be easily configured into and supported in a display position when taken from storage as well.

It is to be understood that the scope of the present invention is not to be limited to the specific embodiments described above. The invention may be practiced other than as particularly described and still be within the scope of the accompanying claims.

What is claimed is:

1. A display article comprising:

a support portion including at least one ledge portion; and a display portion connected to said support portion, said display portion comprising:

first and second side panels;

a third side panel connecting the first and second side panels, and a fourth side panel disposed between and at an angle to said first side panel and said second side panel, said third side panel and said fourth side panel lying in perpendicular planes; and first, second, and third contiguous folding panels connected between said third side panel and said fourth side panel;

said first folding panel being foldable along a first score line adjacent said third side panel and a second score line adjacent said second folding panel;

said second folding panel being foldable along said second score line and a third score line adjacent said third folding panel;

said third folding panel being foldable along said third score line and a fourth score line adjacent said fourth side panel;

said first, second, and third contiguous folding panels comprising a first position wherein said first and second folding panels are coplanar with said third side panel, and said third folding panel is coplanar with said fourth side panel, and said third folding panel is disposed at a right angle to the second folding panel, and a second position wherein said first folding panel is disposed at a right angle to said third side panel and is parallel to said fourth side panel, and said second and third folding panels are coplanar and disposed at a right angle to said fourth side panel and are parallel to said third side panel;

said first, second, and third contiguous folding panels being movable from said first position to said second position upon contact of said first, second, and third panels, with said at least one ledge portion of said support portion.

2. The article of claim 1 wherein said support portion includes at least a first side portion and a second side portion, each of said first side portion and second side portion including at least one ledge portion.

3. The article of claim 2 wherein said support portion further includes at least a third side portion connected to said first side portion and said second side portion of said support portion.

4. The article of claim 3 wherein said support portion further includes a fourth side portion, said fourth side portion connected to said first side portion and said second side portion of said support portion, said fourth side portion of said support portion being parallel to said third side portion of said support portion.

5. The article of claim 4 wherein each of said first and second side portions of said support portion includes a score line, each of said score lines enabling said first and second side portions to be foldable inwardly toward each other.

6. The article of claim 5 wherein at least one of said third side portion and said fourth side portion of said support portion includes a flap portion, said flap portion being foldable inwardly toward the other of said third side portion or said fourth side portion of said support portion, said flap portion upon folding toward said other of said third side portion or said fourth side portion of said support portion, extends said first side portion and said second side portion outwardly along said score line of said first side portion and said score line of said second side portion, thereby retaining said first side portion and said second side portion of said support portion parallel to each other.

7. The article of claim 1 wherein said first side panel and said second side panel of said display portion each includes at least one fold line, said at least one fold line of said first side panel, and said second side panel enabling said first and second side panels to be foldable toward each other when said first, second, and third folding panels are in said first position.

8. The article of claim 1, and further comprising a hinge portion connecting said display portion to said support portion.

9. A blank, comprising:

a first side panel, a second side panel, and a rectangular third side panel, said first side panel and said second side panel being attached to opposite sides of said third side panel, and said first side panel and said second side panel foldable along first and second fold lines, respectively, along said third side panel, and wherein each of said first side panel and said second side panel each includes a first right triangular portion, each of said first right triangular portion of said first and second side panels including a fold line, said fold line of each of said first right triangular portions of said first and second side panels extending from the right angle of each of said right triangular portions of said first and second side panels to the hypotenuse of said first right triangular portions of said first and second side panels; and a first folding panel attached to said third side panel and foldable along a first score line between said first folding panel and said third side panel;

a second folding panel attached to said first folding panel and foldable along a second score line between said first folding panel and said second folding panel;

a third folding panel attached to said second folding panel and foldable along a third score line between said second folding panel and said third folding panel: and a fourth folding panel attached to said third folding panel and foldable along a fourth score line between said third folding panel and said fourth folding panel.

10. The blank of claim 7 wherein each of said first side panel and said second side panel further includes a second right triangular portion, said second right triangular portion attached to said first right triangular portion, said first right triangular portion and said second right triangular portion having a common hypotenuse, said first right triangular portion and said second right triangular portion being foldable along said common hypotenuse.

11. The blank of claim 9 and further comprising a first tab portion attached to said fourth folding panel and foldable along a fold line between said fourth folding panel and said first tab portion.

12. The blank of claim 11, and further comprising a second tab portion attached to said first side portion, and a third tab portion attached to said second side portion.

* * * * *